US005490289A

United States Patent [19]

Lehrer

[11] Patent Number: 5,490,289

[45] Date of Patent: Feb. 13, 1996

[54] BABY BIB

[76] Inventor: Peggy Lehrer, 92 Round Hill Rd., Armonk, N.Y. 10504

[21] Appl. No.: 248,760

[22] Filed: May 25, 1994

[51] Int. Cl.[6] ..... A41B 13/10

[52] U.S. Cl. ..... 2/49.2; 2/49.1; 2/49.5; 2/49.4; 2/46

[58] Field of Search ..... 2/46, 48, 49.1, 2/49.2, 49.3, 49.4, 49.5, 50, 51, 52, 60, 275, 274, 104, 105, 106, 75, 80, 69, 69.5

[56] References Cited

U.S. PATENT DOCUMENTS

| | | | |
|---|---|---|---|
| 540,756 | 6/1895 | Odell | 2/49.2 |
| 593,618 | 11/1897 | Stackhouse . | |
| 686,631 | 11/1901 | McCathie . | |
| 797,434 | 8/1905 | Homeyer . | |
| 860,257 | 7/1907 | Slater . | |
| 889,073 | 5/1908 | Walbridge . | |
| 1,391,121 | 9/1921 | Keppel . | |
| 1,837,983 | 12/1931 | Moran . | |
| 2,170,703 | 8/1939 | Waxman . | |
| 2,244,656 | 6/1941 | Asch . | |
| 2,425,635 | 8/1947 | Nitzberg . | |
| 2,523,565 | 10/1950 | Gardner . | |
| 2,694,199 | 11/1954 | Sanders . | |
| 2,727,239 | 12/1955 | Simon | 2/49.4 |
| 2,835,895 | 5/1958 | Wells . | |
| 2,838,758 | 6/1958 | Townley . | |
| 2,851,690 | 9/1958 | Jennings | 2/50 |
| 2,922,164 | 1/1960 | Liff . | |
| 3,540,060 | 11/1970 | Brown . | |
| 3,999,221 | 12/1976 | Hannigan . | |
| 4,706,303 | 11/1987 | Van Gompel et al. | 2/49.2 |
| 4,710,979 | 12/1987 | Bull et al. | 2/48 |
| 4,779,288 | 10/1988 | Mack | 2/49.2 |
| 4,924,527 | 5/1990 | Hintermeyer | 2/46 X |
| 5,036,547 | 8/1991 | Silas | 2/49.1 |

FOREIGN PATENT DOCUMENTS

| | | | |
|---|---|---|---|
| 749066 | 5/1956 | United Kingdom | 2/49.5 |

*Primary Examiner*—Jeanette E. Chapman
*Attorney, Agent, or Firm*—Schweitzer Cornman & Gross

[57] ABSTRACT

A baby bib includes a first panel being of an elongated construction and having a pair of opposed leg segments extending upwardly to serve as a closure about the neck of the wearer. A neck liner embraces a portion of the periphery of the panel in the area including at least a portion of the legs, and is of a construction which provides a snug and flexible line of contact between the bib and the neck. A second panel of an absorbent material may be removably mounted upon the first panel. The first panel includes a pocket located at a lower edge to collect materials which fall upon the bib and are not retained by the second panel.

5 Claims, 2 Drawing Sheets

BABY BIB

The present invention relates to a clothing-type accessory and, in particular, to a new and improved baby bib.

INTRODUCTION

Numerous approaches have been taken towards providing a protective bib-like article, particularly for infants, to be worn over clothing to protect the clothing from food spills, dribbles and the like. Such bibs are formed of an absorbent material, typically terrycloth or the like, and are made in various shapes and sizes with means for attaching the bib about the neck of the child, usually with a pair of cords or other mating closures. With an improper fit about the neck, liquid or food can travel onto the baby's clothes through the neck gap. Further, upon receipt of large deposits of food material thereon, such bibs tend to soak through, staining the underlying clothing due to their absorbent nature.

An improvement on such cloth bibs are those which are formed of an absorbent material having a thin waterproof backing. While preventing the seepage of all-cloth bibs, they still are "one-use" bibs, requiring laundering after each use.

As another alternative to absorbent bibs, bibs constructed solely of a water-resistant material have been developed. These normally rely on a pocket formed into the bottom edge of the bib to catch the food or liquid. Due to the material from which they are formed, they typically are bulky, do not properly drape over the clothing, and cannot be placed snugly about the neck without constricting the child.

It is a purpose of the present invention to provide a new and improved baby bib of a multiple-layer construction, having improved comfort and protection characteristics over conventional bib designs.

Another purpose of the present invention is to provide an improved baby bib having an absorbent portion as well as a liquidmi-permeable portion to protect the underlying clothes.

Still another purpose of the present invention is to provide a baby bib that has an improved fit about the neck area.

Yet a further purpose of the present invention is to provide an improved baby bib which may be disassembled after use to allow individual cleaning of the constituent parts thereof and which allows the base of the bib to be utilized without the overlying absorbent element.

BRIEF DESCRIPTION OF THE INVENTION

In accordance with the above and other objects, the improved bib of the present invention presents a chest covering surface having a first panel of a waterproof, yet gas-permeable material. The first panel includes an integral neck opening and means associated with the neck opening to adjustably close the opening about the baby's neck. The edge of the neck opening is provided with means to provide a close yet comfortable fit about the neck. A second panel, formed of a liquid-absorbent material, overlies the first panel, and is of reduced area as opposed to the first panel, inset from the border of the first panel. An integral liquid collection pocket is formed at the lower end of the first panel, may overlie the lower portion of the second panel, and collects liquid which falls upon the bib and is not otherwise absorbed by the second panel. The second panel is removably attached to the first panel and may be separated from the first panel for replacement or washing.

The resulting construction provides for efficient absorption of liquid spills and collection of other soiling materials, and allows for laundering and cleaning of the constituent parts in an effective manner.

BRIEF DESCRIPTION OF THE DRAWINGS

A fuller understanding of the present invention will be obtained upon consideration of the following detailed description of a preferred, but nonetheless illustrative, embodiment thereof, when reviewed in conjunction with the annexed drawings, wherein.

DETAILED DESCRIPTION OF THE INVENTION

Figure 1:
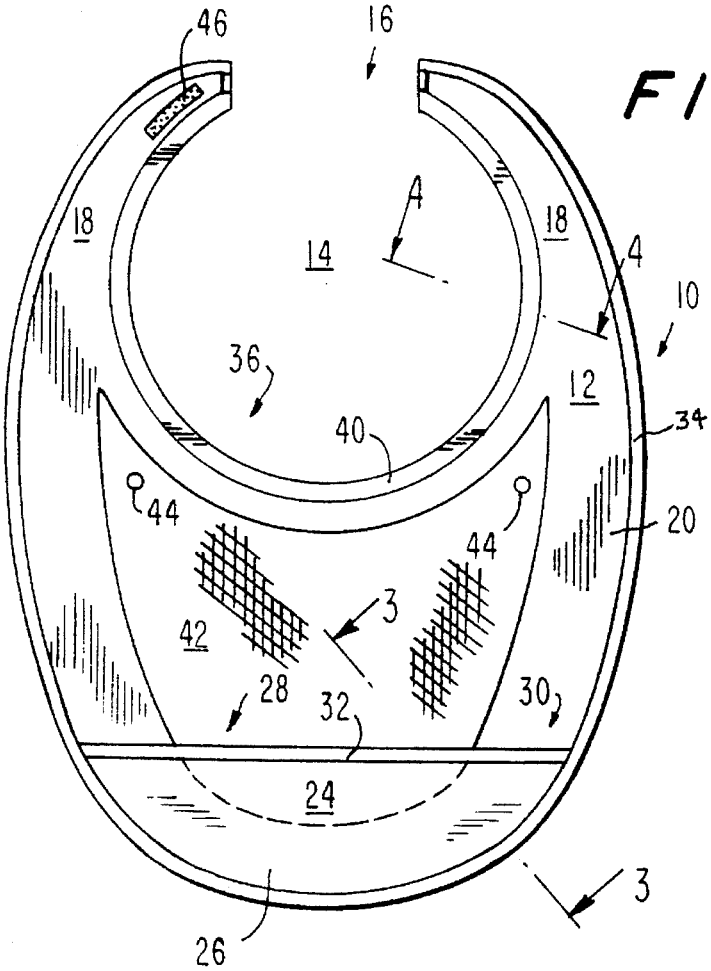
FIG. 1 is a front elevation view of a bib of the present invention.

With reference to the Figures, the bib 10 of the present invention includes a first base panel 12 of generally oval shape, having a neck opening 14, the entranceway 16 thereof being formed by the opposed legs 18. The panel 12 is preferably formed with a top layer 20 of a waterproof material being sufficiently gas-permeable or "breathable" to be comfortable for the child. Preferably, the material may be SUPPLEX brand nylon of the Dupont Corporation, provided with a highly water-resistant coating, such as Dupont's TEFLON brand microporous coating, combined with a DUREPEL anti-stain finish treatment of Burlington Industries. Such material retains a soft hand, but provides a high degree of water repellency and stain resistance. The nylon top layer 20 of the panel 12 is backed by a contiguous layer 22 of a soft and absorbent material, such as a polyester/cotton broadcloth, which adds body to the construction and eliminates the tendency of teflon-treated materials to "fly" or lift away from the underlying surface. The present construction lies against the clothing article which the bib is intended to protect.

Figure 3:
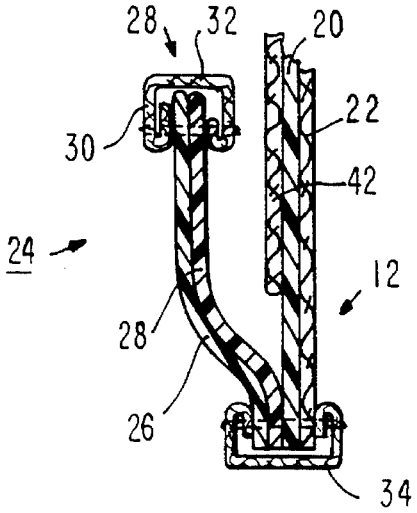
FIG. 3 is a section view taken along line 3—3 of FIG. 1.
Figure 2:
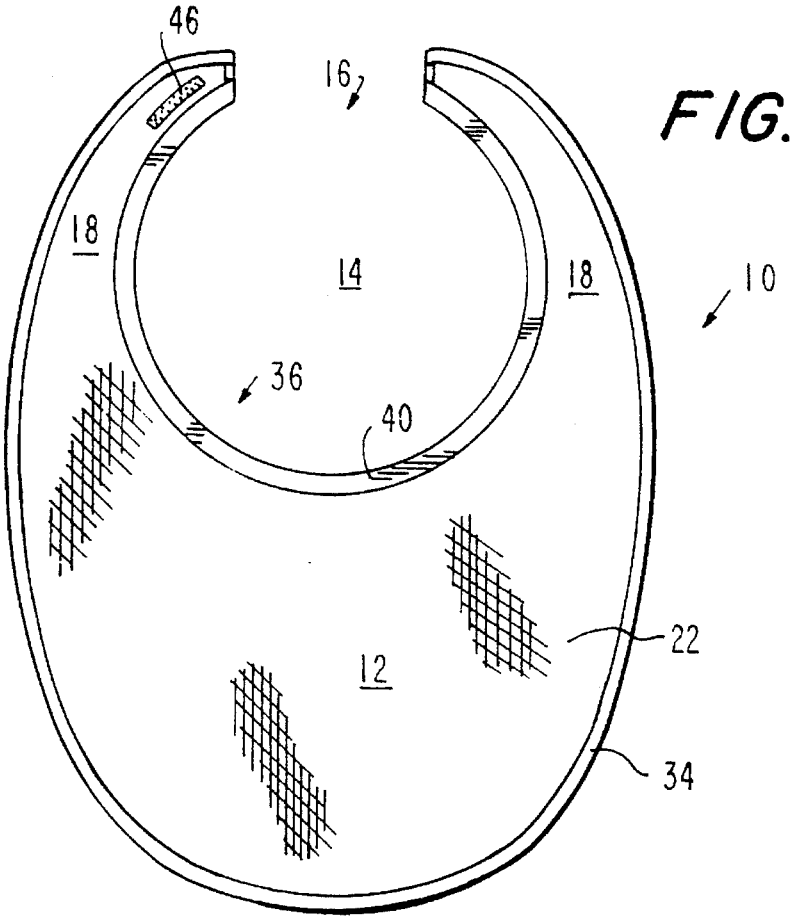
FIG. 2 is a rear elevation view thereof.

The lower portion of the panel 12 is provided with an overlying pocket 24 adapted to collect drips and solid particles which fall on the bib and are not otherwise retained on the surface thereof. As detailed in FIG. 3, the pocket 24 is formed of an outer layer 26 of the same material as the top layer 20 of panel 12, mated with an inner layer 28 of broadcloth or similar material having an absorbency for liquids. The pocket is formed with a horizontal free edge 28 and a curved lower edge which aligns with the lower portion of the base panel 12. The upper, free edge 28 of the pocket is sealed with an overlying wrap of bias tape 30, as known in the art, stitched through the layers of the pocket.

The outer edge of the base panel 12 is similarly finished with a length 34 of bias tape which secures together the front and back layers 20, 22, as well as the layers 26 and 28 of the overlying pocket 24 at the lower portion of the bib and forming a watertight edge for the pocket. The bias tape finishing extends about the outside periphery of base panel 12, including the inner sides of the neck-embracing legs 18.

Figure 4:
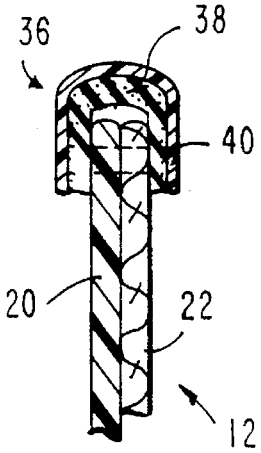
FIG. 4 is a section view taken along line 4—4 of FIG. 1.

In order to provide a snug yet comfortable fit of the bib about the neck of the child, the peripheral inner edge portion 36 of the base panel 12 which encircles the neck opening 14 is provided with a cushioned and resilient finished neck liner edge detailed in FIG. 4. As shown therein, the edge is provided with a first overlying bias tape element strip 38, which is overlaid with a second, exposed strip 40 of a flexible and water-proof cushioning material. The strip 40 is preferably a composite, having an exposed nylon face backed with a sponge rubber rear layer. Such a strip material retains the elasticity and cushion of the rubber layer while having the finished appearance, comfortable feel and protection provided by the nylon wear surface. The bias tape and rubber strip are stitched about the neck opening edge 36 in a conventional manner, the rubber strip being allowed to flex to insure that a close but comfortable fit may be achieved about the neck.

Overlying the central portion of the base panel 12 is absorbent second panel 42. Panel 42, which is generally crescent shaped, is positioned with its upper margin directly below the neck opening to receive the majority of spills landing upon the bib. The panel 42 is preferably formed of a highly absorbent and washable fabric, such as terrycloth. A pair of snap fasteners 44 are located at the top corners of the panel, and allow releasable attachment of the panel to a mating pair of fasteners mounted to the base panel 12. They also allow the second panel to be lifted from the base panel 12 to allow spills, for example, to be wiped from the baby's face without removing the bib. The panel 42 extends downwardly across the face of the main panel 12, the lower extremity of the second panel preferably lying within the upper portion of the pocket 24.

The opposed legs 18 of the base panel 12 are provided with complementary fastener elements 46 to allow the bib to be placed about the child's neck in a manner which is snug yet not constricting. Preferably, the fasteners 46 include length of complementary hook and loop closure material, a first piece being affixed to the front surface of a first leg and a second piece being affixed to the rear surface of the other leg. The lengths of the closure pieces are chosen to be sufficiently long to allow adjustability in the overlap thereof, and accordingly the neck size, to accommodate the child.

As the base panel 12 is waterproof, it insures that drips falling upon the bib do not pass through and stain the underlying child's garment. The utilization of a unique flexible neck encompassing edge allows the bib to be placed snugly about the child's neck without chafing. Because second panel 42 is of an absorbent material, spills are retained on the bib. Pocket 24, however, provides for additional retention of spills, which are either of a volume or rate which cannot be completely absorbed by the second panel 42, or are of a solid or liquid composition which prevents their effective retention by the second panel. It also serves as the primary retention means for spills when the base panel is utilized without the second panel. As the pocket is of a waterproof construction, leakage of the retained materials is avoided. Additionally, however, as the inner surface of pocket 24 is of an absorbent material, the retained spills are captured and subsequent spillage from the pocket is eliminated.

Because the second panel is removable and is of a washable material, it may be easily separated from the underlying base panel and laundered as required. Its removability also allows the substitution of second panels as desired, which panels may be provided with designs, picture indicia or the like, to enhance their appearance. The underlying base piece 12 can be easily cleaned by a wiping process yet is of a construction which allows laundering if necessary.

I claim:

1. A bib, comprising a first panel adapted to overlie the chest region of a wearer, said first panel being of an elongated construction, having a first, outwardly-lying, water-resistant layer and a second, inwardly-lying fabric layer, and having a pair of opposed leg segments extending upwardly at an upper margin thereof; cooperating attachment means mounted to a distal end of each of said legs to join said legs at any of a plurality of positions to adjustably size the legs about a neck of the wearer; a second panel of an absorbent material removably mounted upon an outwardly-lying surface of said first panel in a central position thereon; a pocket located on said outwardly-lying surface of said first panel and extending upwardly from a lower edge thereof, said pocket comprising a first, outwardly-lying, water-resistant material layer and a second, inwardly-lying fabric layer, said second panel extending downwardly below the top margin of said pocket; and a neck liner affixed about a portion of said first panel in an area including at least a portion of said legs for embracing the neck of the wearer, said liner comprising means for providing a snug and flexible line of contact between the bib and neck.

2. The bib of claim 1, wherein said first layer is nylon and said second layer is terrycloth.

3. The bib of claim 2, wherein said pocket includes a first top edge and a second lower peripheral edge joined to said lower edge of said first panel.

4. The bib of claim 3 further including means for fastening said first and second layers of said first panel together about a common periphery thereof.

5. The bib of claim 1, wherein said neck liner comprises a first layer of sponge rubber and a nylon sheath.

* * * * *